United States Patent [19]

Leger

[11] Patent Number: 4,616,428

[45] Date of Patent: Oct. 14, 1986

[54] PROTECTIVE SLIPPER ADAPTABLE TO DIFFERENT SIZES

[75] Inventor: Claude Leger, Thourotte, France

[73] Assignee: Dispovet, France

[21] Appl. No.: 695,260

[22] Filed: Jan. 28, 1985

[30] Foreign Application Priority Data

Dec. 21, 1984 [FR] France ..... 84 19732

[51] Int. Cl.[4] ..... A43B 3/16; A43B 1/14; A43B 7/12

[52] U.S. Cl. ..... 36/7.1 R; 36/7.3; 36/9 R; 12/142 G; 12/142 K

[58] Field of Search ..... 36/7.1 R, 7.3, 9 R, 36/9 A, 1, 3 R, 10; 12/142 K, 142 G; 361/223, 224

[56] References Cited

U.S. PATENT DOCUMENTS

| | | | |
|---|---|---|---|
| 2,305,926 | 12/1942 | Kohler | 36/9 R |
| 3,000,118 | 9/1961 | O'Shea | 36/10 |
| 3,283,422 | 11/1966 | Nygard | 36/7.3 X |
| 3,634,954 | 1/1972 | Larsen et al. | 36/7.3 |
| 4,023,281 | 5/1977 | Terry | 36/7.1 R |
| 4,272,859 | 6/1981 | Vanhove | 12/142 K |

FOREIGN PATENT DOCUMENTS

| | | | |
|---|---|---|---|
| 803023 | 2/1951 | Fed. Rep. of Germany | 36/7.1 R |
| 2527907 | 12/1983 | France . | |
| 2532337 | 3/1984 | France . | |

*Primary Examiner*—James Kee Chi

*Attorney, Agent, or Firm*—Steele, Gould & Fried

[57] ABSTRACT

This slipper, which may be used in particular as an overshoe and is adaptable to feet of different foot sizes, comprises a series of elastic gathers 27 along the upper edge defining an opening of the slipper and is characterized in that it comprises at least one second series of elastic gathers 28 placed in an intermediate region between the upper edge and the sole of the slipper. Application in protective slippers or overshoes for use over a short period, in particular in the medical, industrial and nuclear fields.

10 Claims, 6 Drawing Figures

PROTECTIVE SLIPPER ADAPTABLE TO DIFFERENT SIZES

The present invention relates to slippers of use in particular as overshoes in the medical, industrial and nuclear fields.

In order to facilitate the operations for manufacturing, storing and using such slippers, articles have been made which have a single size and are utilizable by persons having different foot sizes. In a known construction, the overshoe is made from a sheet of a suitable material which is cut out and then folded around a region which corresponds to the rear part of the slipper, the confronting edge portions of the cut-out sheet being assembled by stitching with incorporation of an elastic band which permits the obtainment of the desired adaptation to the different shoe sizes. An elastic band is also incorporated in the upper part of the slipper which remains of course open, so as to tighten the overshoe around the ankle of the user.

This construction has serious drawbacks. There exists along the entire median part of the sole a stitching in which an elastic band is incorporated and this results in a hindrance for the user since the sole is not flat. Further, the presence of this same stitching under the sole has for result that the fluidtightness cannot be effectively achieved in this region, even if the material employed for making the overshoe is fluidtight by nature. Indeed, as a result of the stitching, there are a certain number of piercings which adversely affect this fluidtightness.

Another drawback of this type of construction results from the difficulty of using a material such as a polyethylene which does not lend itself well to stiching operations and yet would provide the best qualities of fluidtightness and anti-slip.

Lastly, this type of article does not lend itself well to a manufacture of the automatized type and this increases the cost.

An object of the invention is consequently to provide a slipper which may be used, in particular as an overshoe, which overcomes these various drawbacks and which, more precisely, is perfectly fluidtight, has a continuous and practically flat sole, can be made from different materials and lends itself to an industrialized mass-production.

The invention therefore provides a slipper adaptable to feet of different sizes comprising, in the region of its upper part, an elastic band forming a series of gathers, said slipper further comprising at least one second elastic band placed in an intermediate region between the upper part and the sole of the slipper and forming in said region a second series of gathers.

According to other features of the invention:

- the two series of gathers are roughly parallel to each other;
- the slipper is made from two superposed sheets of the same material on which are fixed elastic bands for forming the gathers, these two sheets being joined together along a weld line;
- the slipper comprises an inner element and an outer element defining the sole and a part of the upper of the slipper;
- the second series of gathers is disposed in the vicinity of the upper edge of the outer element;
- the slipper comprises in the vicinity of the ends of its opening two tabs in the region of which is formed at least one weld between the two sheets constituting the two ends of the slipper.

Another object of the invention is to provide a method for manufacturing such a slipper and comprising starting with two sheets of a material which must constitute said slipper, fixing on each of said sheets two elastic bands, one of which is disposed in the region of the upper edge portion defining the opening of the slipper while the other is disposed in an intermediate region between said upper edge portion and the part of the sheet which will constitute the sole, the elastic bands being previously put under tension so as to subsequently form gathers when they are released, then welding and cutting out the two superposed sheets along a line giving the shape of the slipper.

According to another feature of this method, four sheets are taken and superposed one on top of the other, the elastic bands for forming the second series of gathers being disposed respectivaly between an inner sheet and an outer sheet.

The invention will be described in more detail hereinafter with reference to the accompanying drawings which are given solely by way of example and in which:

FIG. 1 shows a slipper or overshoe according to the invention which is made from two sheets of a material which may be, for example, a polyethylene having a thickness of 50 microns, these sheets being fluidtight and preferably treated in such manner as to possess on one side a goffering or embossing which imparts anti-slip properties to the slipper.

Figure 1:
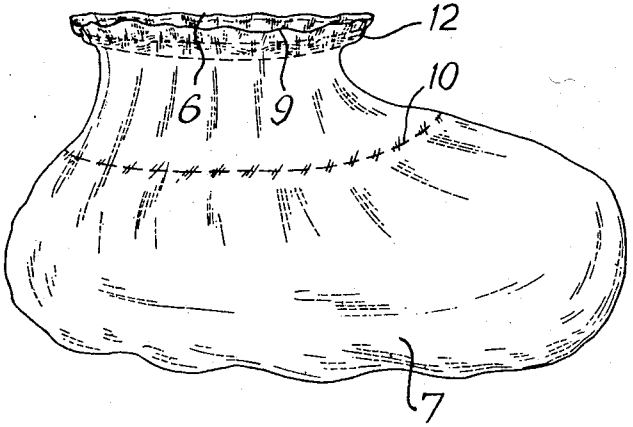
FIG. 1 is a perspective view of a slipper according to the invention.
Figure 2:
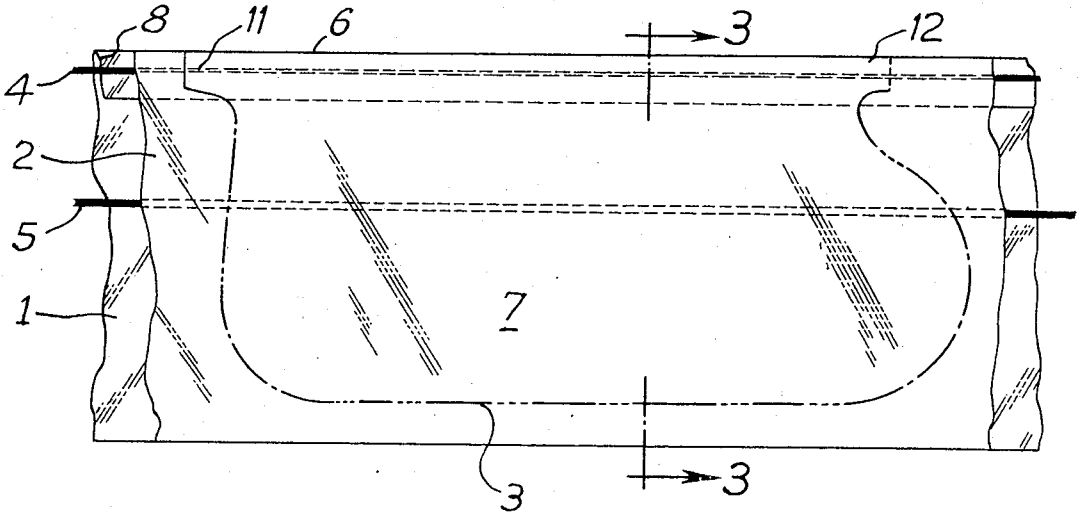
FIG. 2 is a plan view illustrating a stage of the method for manufacturing such a slipper.
Figure 3:
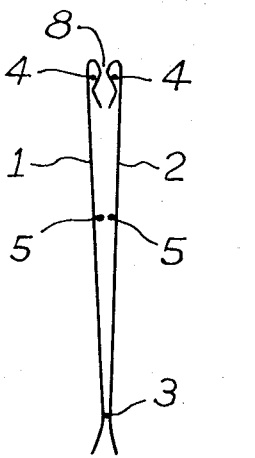
FIG. 3 is a sectional view taken on line 3—3 of FIG. 2.

This slipper is made from two superposed sheets 1, 2 which are welded together and cut out along a line 3 which may be, for example, that shown in dot-dash lines in FIG. 2. On each of these sheets are welded two elastic bands 4, 5, the band 4 being disposed on the vicinity of the upper edge 6 of the slipper and the other band 5 being disposed in an intermediate region between this upper edge and the part 7 of the sheet which will constitute the sole. Prior to their fastening to the adjacent sheets, and during this fastening, the elastic bands are placed under tension so that gathers 9, 10 as shown in FIG. 1 are obtained when the bands are released. The two series of gathers are preferably roughly parallel to each other. The elastic bands may be simple or taped. The elastic band 4 which is located along the upper edge of the overshoe may be disposed in a hem 8 formed by a formed-over edge portion of the sheet of polyethylene.

Preferably, in the vicinity of the two ends of the free upper edge of the slipper, the sheets are cut out so as to form two tabs 11, 12 in the region of which a plurality of welds are formed so as to improve the strength of the slipper in these two regions.

The cutting-out and welding line of the sheets is so chosen that the slipper can be used by users having different foot sizes, the adaptation to these different sizes being achieved owing to the presence of the elastic bands 4, 5 and the gathers 9, 10 located at two levels.

Figure 4:
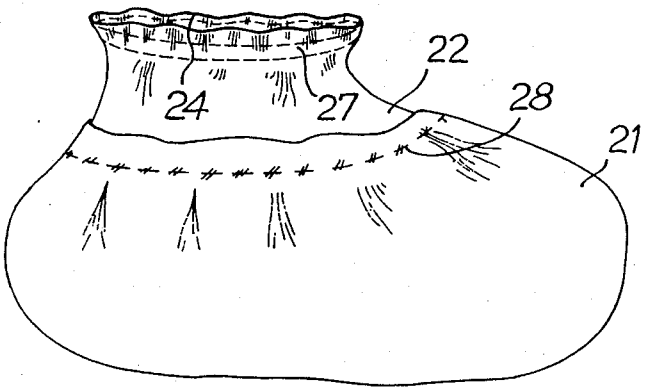
FIG. 4 is a perspective view of another embodiment of the slipper.
Figure 5:
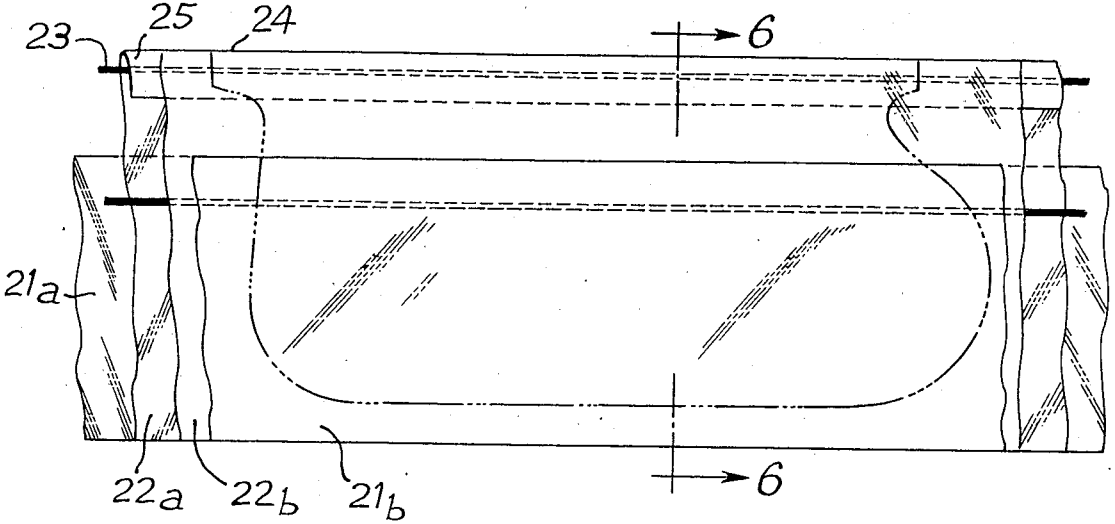
FIGS. 5 and 6 are similar to FIGS. 2 and 3 and illustrate two stages of the method for manufacturing the slipper shown in FIG. 4.
Figure 6:
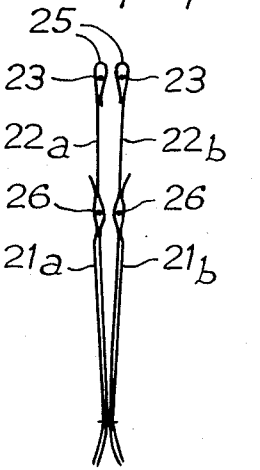

In the embodiment shown in FIG. 4, the slipper is made by using two different materials which may be, for example, a polyethylene similar to that used in the embodiment shown in FIG. 1 and a polypropylene, for example non-woven, of about 20 to 40 grams/$m^2$.

The fluidtight polyethylene 21 constitutes the outer element of the sole, while the non-woven material 22 based on polypropylene constitutes the inner and upper part of the slipper and permits a certain amount of aeration.

The manufacturing method is similar to that described hereinbefore, namely, the method comprises,for making a slipper, using two bands 21*a*, 21*b* of polyethylene and two bands 22*a*, 22*b* of polypropylene, the latter having a width which is larger than that of the two bands of polyethylene and being placed between the two sheets of polyethylene.

The elastic bands 23 alongside the upper edge 24 of the slipper are preferably received in hems obtained by folding over a flap 25 of the sheets of polypropylene. The elastic bands 26 disposed in the intermediate region are preferably received between the sheets of polypropylene and polyethylene and welded to the latter.

The shape of the welding and cutting-out lines may be the same as in the first embodiment.

As before, there are obtained two lines or series of elastic gathers 27, 28 which allow the use of a slipper of a single size by persons having different foot sizes.

The resulting advantages are the following:

- in view of the position of the line of gathers in an intermediate region between the upper edge and the sole of the slipper, this sole is practically without any extra thickness, even in the region of the weld between the sheets of the material constituting the slipper;
- the sole is preferably fluidtight, as there is no stitching;
- the slipper may be mass-produced from rolls of polyethylene, polypropylene or other suitable materials and from continuously-fed elastic bands, which enables particularly competitive production rates and cost prices to be obtained;
- in its most elaborate version, the slipper according to the invention provides better comfort since the inner element may be made from a material which provides a certain amount of aeration while the outer element is fluidtight and so treated as to be also anti-slip.

According to a modification, another series of elastic gathers may be provided in the region of the upper part of the slipper without complicating very much its manufacture.

Further, although a preferred method has been described, such a slipper may be made by other methods employing adhesion or other techniques.

In this respect, in the first embodiment described and illustrated, it may be desirable in order to improve the adherence between the elastic band and the adjacent sheet, to add an additional narrow band, the elastic band being then welded between the sheet and said additional band.

What is claimed is:

1. A slipper which may be used in particular as an overshoe and is adaptable to feet of different sizes, comprising two susperposed first sheets of a first material, united along a weld line. an upper edge defining an opening, a sole, a first series of elastic gathers along said upper edge, two second sheets of a second material connected one to the other and to the first sheets by said weld line, these first sheets being placed between the second sheets, each second sheet being further connected to the adjacent first sheet by at least one other weld line and at least one second series of elastic gathers located in an intermediate region between said upper edge and said sole along said other weld line.

2. A slipper according to claim 1, said slipper further comprising, in the vicinity of ends of said openings, two tabs in the region of which at least one weld between said two first sheets is formed.

3. A slipper according to claim 1, wherein said second sheets define the sole and a part of an upper of the slipper.

4. A slipper according to claim 1, wherein the first material is an aeration providing material and wherein the second material is fluidtight.

5. A slipper according to claim 1 wherein the slipper comprises a second series of elastic gathers located in an intermediate region between said upper edge and said sole.

6. A slipper according to claim 5 wherein said two series of gathers are roughly parallel to each other.

7. A slipper according to claim 6 wherein the second series of gathers is disposed in the vicinity of an upper edge of said second sheets.

8. A slipper according to claim 5 wherein said second series is disposed along the upper edge of said second sheets.

9. A slipper according to claim 5 wherein said material is an aeration providing material and said second material is fluid tight.

10. A disposable fluid-tight overshoe comprising an outer portion and an inner portion, each of said outer and inner portions comprising two superposed sheets of weldable material united along a weld line, said inner portion having at an upper edge an opening and at the lower end an inner sole, an elastic band fixed to said upper edge of said inner portion and forming a series of gathers, said outer portion being of liquid-tight material and united at the bottom portion in a common weld line with said inner portion to define an outer sole, the upper edge of said outer portion being intermediate the sole and upper portion of said inner portion and having fixed thereto an elastic band forming a series of gathers.

* * * * *